US010596590B2

(12) United States Patent
Haynes

(10) Patent No.: US 10,596,590 B2
(45) Date of Patent: Mar. 24, 2020

(54) FLOW RESTRICTOR

(71) Applicant: DFUND LIMITED, Auckland (NZ)

(72) Inventor: Andrew Leo Haynes, Auckland (NZ)

(73) Assignee: DFUND LIMITED, Auckland (NZ)

( * ) Notice: Subject to any disclaimer, the term of this patent is extended or adjusted under 35 U.S.C. 154(b) by 0 days.

(21) Appl. No.: 15/856,583

(22) Filed: Dec. 28, 2017

(65) Prior Publication Data

US 2018/0221912 A1 Aug. 9, 2018

Related U.S. Application Data

(63) Continuation of application No. 13/849,153, filed on Mar. 22, 2013, now Pat. No. 9,943,876.

(60) Provisional application No. 61/662,311, filed on Jun. 20, 2012.

(30) Foreign Application Priority Data

Mar. 22, 2012 (NZ) ..... 598974

(51) Int. Cl.
*B05C 17/005* (2006.01)
*B65D 83/00* (2006.01)
*B05C 17/01* (2006.01)

(52) U.S. Cl.
CPC .. *B05C 17/00516* (2013.01); *B05C 17/00503* (2013.01); *B65D 83/0022* (2013.01); *B05C 17/01* (2013.01)

(58) Field of Classification Search
CPC .. B65D 83/0022; B65D 47/043; B65D 47/06; B65D 25/48; B05C 17/01; B05C 17/00516; B05C 17/00513; B05C 17/00503
See application file for complete search history.

(56) References Cited

U.S. PATENT DOCUMENTS 4,340,154 A 7/1982 Vanmanen
4,382,530 A 5/1983 Calisto
4,878,599 A * 11/1989 Greenway ..... B65D 47/10 222/1

(Continued)

FOREIGN PATENT DOCUMENTS

DE 20313436 1/2004

OTHER PUBLICATIONS

AU Examiner's Action for AU Patent Appl. No. 2013201817, dated Apr. 22, 2014, 4 pages.

(Continued)

*Primary Examiner* — Nicholas J. Weiss
(74) *Attorney, Agent, or Firm* — Foley & Lardner LLP

(57) ABSTRACT

This invention relates to an apparatus for dispensing a viscous fluid whether in combination, disassembly or assembly. The apparatus comprising a cartridge, reservoir or tube containing the fluid and having an openable or opened outlet structure which, when opened, allows the expression of the fluid from a created outlet aperture. A nozzle is engaged or engageable to the outlet structure and/or cartridge, reservoir or tube whereby fluid expressed from the outlet aperture can subsequently move to and be expressed from the nozzle outlet. The openable or opened outlet structure is adapted to provide on opening at least one outlet aperture having a size of area A; and wherein the nozzle has or is adapted to be cut to provide a nozzle outlet of area B, area B being greater than or equal to area A.

15 Claims, 12 Drawing Sheets

(56) References Cited

U.S. PATENT DOCUMENTS

| | | | | |
|---|---|---|---|---|
| 5,104,013 | A | 4/1992 | Hawley | |
| 5,248,071 | A | 9/1993 | Ray | |
| 5,297,697 | A | 3/1994 | Boring | |
| 5,501,370 | A | 3/1996 | Okamura et al. | |
| 6,364,163 | B1 | 4/2002 | Mueller | |
| 6,626,331 | B2 * | 9/2003 | Yenglin | B65D 1/32 222/158 |
| 7,631,790 | B2 * | 12/2009 | Braams | B05C 17/00513 222/527 |
| 8,364,163 | B2 | 1/2013 | Preiss | |
| 2002/0076260 | A1 | 6/2002 | Heusser | |
| 2009/0114684 | A1 | 5/2009 | Helmenstein | |
| 2015/0014372 | A1 * | 1/2015 | Proud | B65D 47/065 222/567 |

OTHER PUBLICATIONS

AU Examiner's Action for AU Patent Appl. No. 2013201817, dated Sep. 16, 2014, 2 pages.

New Zealand Examination Report dated Mar. 27, 2013 for New Zealand Patent Application No. 608627, counterpart foreign application of U.S. Appl. No. 13/849,153, 3 pages.

International Search Report and Written Opinion dated Jul. 1, 2013 for PCT/NZ2013/000048, 13 pages.

* cited by examiner

FLOW RESTRICTOR

CROSS-REFERENCE TO RELATED APPLICATIONS

This application is a continuation of, and claims priority to, U.S. patent application Ser. No. 13/849,153, filed on Mar. 22, 2013, which claims priority to U.S. Provisional Application No. 61/662,311, filed on Jun. 20, 2012, entitled "A FLOW RESTRICTING NOZZLE," and also claims priority to New Zealand Patent Application Ser. No. 598974, filed on Mar. 22, 2012, the complete disclosures of which are all incorporated by reference herein.

FIELD OF THE INVENTION

The present invention relates to devices and assemblies for assisting in the dispensing and application of a bead of viscous material along a join, channel or surface.

BACKGROUND TO THE INVENTION

It is common for sealing, caulking and adhesive agents or similar paste-like, gel-like or viscous materials to be applied to surfaces or between surfaces by extruding the substance through a nozzle whilst simultaneously moving the nozzle in order to form a bead that extends along the surfaces or edges to be joined or sealed.

There are a wide variety of implements designed to assist in the formation and application of the bead of material. Often the material is supplied in a cartridge which allows, via a trigger mechanism or otherwise, for a user to express the material from the cartridge. Usually the material is expressed through a nozzle to improve the accuracy and evenness of the bead.

The nozzle may be integral to the cartridge, or may be a separate component which is attached to the cartridge after an opening through which to express the material has been created in the cartridge. The cartridge will often have a somewhat cylindrical protrusion with an appropriately sized diameter which can be cut away by a saw or knife to form such an opening when required.

Even with the nozzled implement, it is difficult to control the flow of the viscous material, and therefore the result is an undulating and variable bead. Sometimes the application of the material may be discontinuous along the length of the surface or join.

Often more material than is needed will flow from the nozzle, causing mess and wastage. This not only looks unattractive, but also means that different portions of the bead will have different drying times. In some instances, for example when applying adhesive, the user will have to subsequently wipe over the bead to flatten it into a thin even material layer. This is essential to ensure the integrity of the bond formed.

The shape and consistency (particularly in cross section) of the bead are directly affected by the magnitude of the pressure applied to the cartridge and the speed at which the user moves the nozzle along the surface or join. Typically there is little to assist the user in regulating either of these parameters except for, perhaps, the user's own skill and experience. The response of the implement, especially to variations in pressure, can be unpredictable and/or variable; and this makes it difficult for the user to regulate the flow of the viscous material effectively. In some circumstances the application of a continuous pressure will still result in intermittent bead formation.

It is therefore an object of the current invention to provide an implement which will assist in effectively regulating the flow of a viscous material expressed under pressure from a cartridge and through a nozzle; or at least to provide the public with a useful choice.

It is a further or alternative object of the present invention to provide an implement which will assist a user in the accurate application of an evenly shaped and consistent bead of viscous material along a join, channel or surface; or at least to provide the public with a useful choice.

It is a further or alternative object of the present invention to ameliorate, at least to some degree, the problems identified above; or at least to provide the public with a useful choice.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

Further aspects and advantages of the present invention will become apparent from the ensuing description which is given by way of example only.

SUMMARY OF THE INVENTION

In one aspect the invention is an apparatus for dispensing a viscous fluid, (whether in combination, disassembly or assembly) the apparatus comprising or including a cartridge, reservoir or tube containing the fluid and having an openable or opened outlet structure which, when opened, allows the expression of the fluid from a created outlet aperture, and a nozzle engaged or engageable to the outlet structure and/or cartridge, reservoir or tube whereby fluid expressed from the outlet aperture can subsequently move to and be expressed from the nozzle outlet;

wherein the openable or opened outlet structure is adapted to provide on opening at least one outlet aperture having a size of area A;

and wherein the nozzle has or is adapted to be cut to provide a nozzle outlet of area B, area B being greater than or equal to area A.

Preferably said viscous fluid is a sealing, grouting, caulking, levelling, joining agent, an adhesive, and/or another type of viscous liquid, acid, foam, lotion, paste or gel.

Preferably an inner surface (and optionally also an outer surface) of said opening structure comprises a series of one or two or more concentric cylindrical protrusions.

Preferably an inner surface (and optionally also an outer surface) of said opening structure comprises a substantially conical or frustoconical surface.

Preferably an inner surface (and optionally also an outer surface) of said opening structure comprises a stepped or otherwise progressively reducing cross section.

Preferably said outlet aperture is formed by cutting away or otherwise removing a portion of the outlet structure. Alternatively, the outlet structure comprises a frangible film or membrane, such a film or membrane frangible or capable of being removed or ruptured, more preferably can be removed or ruptured manually by a user or may be removed on application of said external pressure to form said outlet aperture. For example, a relatively thin polymer film or membrane may be provided for sealing purposes of the outlet structure, which once removed, provides for the outlet aperture of a pre-determined size. Such a pre-determined size being equal to or less than the cross-sectional area of the nozzle outlet.

Preferably said outlet aperture is formed by cutting away or otherwise removing a portion of the outlet structure in a plane at least substantially perpendicular to the longitudinal axis of the outlet structure.

Preferably said outlet aperture is substantially circular.

Preferably the size of said outlet aperture can be selected by locating the cutting plane at particular positions along the longitudinal axis of the outlet structure. Alternatively, the outlet aperture can be selected by selectively removing a frangible film or membrane, such a film or membrane frangible or capable of being removed or ruptured, more preferably can be removed or ruptured manually by a user or may be removed on application of said external pressure to form said outlet aperture.

Preferably there are steps, grooves, notches or other markings or profile features on the outer surface of the outlet structure to:

indicate the various positions at which the cutting plane can be located to achieve the desired outlet aperture size; and/or assist in the accurate cutting or removal of material from the outlet structure in a plane located at a particular position.

Preferably said outlet structure is adapted by the insertion of a flow restricting component within or proximate to said outlet structure to provide said aperture. Alternatively, the flow restricting component comprises a frangible film or membrane, such a film or membrane frangible or capable of being removed or ruptured, more preferably can be removed or ruptured manually by a user or may be removed on application of said external pressure to form said outlet aperture through which said fluid can be expressed into said nozzle.

For example, a relatively thin polymer film or membrane may be provided for sealing purposes of the outlet structure, which once removed, provides for the outlet aperture of a pre-determined size. Such a pre-determined size being equal to or less than the cross-sectional area of the nozzle outlet.

For example, the outlet structure may have a pre-determined size of outlet, which, upon removing of a portion of material (e.g. such as a film or membrane or other material), can provide for an outlet of a size less than the outlet aperture.

Preferably an inner surface (and optionally also an outer surface) of said flow restricting component comprises a series of one or two or more concentric cylindrical protrusions.

Preferably an inner surface (and optionally also an outer surface) of said flow restricting component comprises a substantially conical or frustoconical surface.

Preferably an inner surface (and optionally also an outer surface) of said flow restricting component comprises a stepped or otherwise progressively reducing cross section.

Preferably said outlet aperture is formed by cutting away or otherwise removing a portion of the flow restricting component. Alternatively, the outlet aperture can be selected by selectively removing a frangible film or membrane, such a film or membrane frangible or capable of being removed or ruptured, more preferably can be removed or ruptured manually by a user or may be removed on application of said external pressure to form said outlet aperture.

Preferably said outlet aperture is formed by cutting away or otherwise removing a portion of the flow restricting component in a plane perpendicular to the longitudinal axis of the restricting component.

Preferably said outlet aperture is substantially circular.

Preferably the size of said outlet aperture can be selected by locating the cutting plane at particular positions along the longitudinal axis of the flow restricting component.

Preferably there are steps, grooves, notches or other markings or profile features on the outer surface of the flow restricting component to:

indicate the various positions at which the cutting plane can be located to achieve the desired outlet aperture size; and/or assist in the accurate cutting or removal of material from the flow restricting component in a plane located at a particular position.

Preferably said flow restricting component is integral to or associable with said nozzle.

Preferably said outlet structure can be adapted by the insertion, within or proximate to said outlet structure, of one of a series of interchangeable flow restricting components, each providing a different sized outlet aperture. For example, each of said flow restricting components comprises said outlet aperture such that each such outlet aperture is of a pre-determined size.

Preferably said flow restricting component may be integral to the shape of the outlet structure of the cartridge, reservoir or tube, and may be provided by way of a separate insert fitted between a nozzle (e.g. a conical nozzle) and the outlet structure of the cartridge, reservoir or tube. For example, the nozzle could be integral with the cartridge, reservoir or tube.

Preferably, the flow restricting component ensures there is less pressure inside the nozzle and/or at the nozzle outlet aperture, than of the fluid within the cartridge, reservoir or tube. For example, there is a reduced pressure differential between the pressure of fluid within the nozzle and the fluid ejected or expressed from the nozzle out. Advantageously, this may help reduce fluid leaking from the nozzle outlet after a user has stopped actively applying pressure (e.g. squeezing) to the cartridge (etc).

For example, preferably the apparatus provides for a reduced pressure differential between fluid in the cartridge, container or tube and the fluid in the nozzle when said fluid is being expressed.

Preferably the flow restricting component provides for one or more openings through which the fluid (e.g. contents of the cartridge, reservoir or tube) can flow.

Preferably said outlet structure can be adapted, by the insertion of a flow restricting component as previously described or otherwise, to provide an outlet aperture having a diameter of any desired size selected from the range of diameters between 1 mm and 10 mm.

Preferably the fluid may be ejected from the cartridge, reservoir or tube through an outlet, and encounter a flow restricting component (or an orifice or aperture of such a component), before flowing through said nozzle (e.g. a conical nozzle, although may not be limited to such), such fluid then being ejected out through the nozzle outlet to form a bead under a continuous or substantially continuous pressure.

Preferably the apparatus is a combination of a cartridge, container or tube containing the fluid and a nozzle attachable to duct to a nozzle outlet fluid to be expressed from the cartridge, container or tube via an outlet profile when opened, the outlet profile being openable by cutting or the like selectively of the profile to define an opening of increasing area $A_1$, $A_2$ etc;

wherein the nozzle outlet is of area $B_1$ (but optionally can be cut to greater area $B_2$ etc);

and wherein at least $A_1$ is less than or equal to in area than $B_1$.

Preferably area $A_2$ is less than or equal to in area than $B_2$ etc.

Preferably the apparatus further comprises (whether in combination, assembly or disassembly) a cartridge, container or tube having an outlet region; and an attachable nozzle having an inlet region and an outlet region;

wherein a viscous fluid to be expressed from the cartridge, container or tube into and out of the nozzle is restricted or to be restricted by a smaller or equal sized inlet region into the nozzle from the cartridge, container or tube than the size of the nozzle outlet region.

Preferably wherein said viscous fluid is a sealing, grouting, caulking, levelling, joining agent, an adhesive, and/or another type of viscous liquid, acid, foam, lotion, paste or gel.

Preferably wherein said outlet region of the cartridge container or tube is defined by an outlet profile having an opening.

Preferably wherein said outlet profile is provided by the insertion of a flow restricting component within or proximate to an outlet region of said cartridge, container or tube.

Preferably wherein said apparatus comprises a flow restricting component for use in conjunction with a cartridge, reservoir or tube containing viscous contents, said cartridge, reservoir or tube having an outlet region and a mechanism by which its contents can be expressed or ejected through the outlet region under the application of external pressure;

wherein said flow restricting component is adapted to fit over or inside of said outlet region;

and wherein said flow restricting component provides one or more openings through which the contents can subsequently flow.

Preferably wherein portions of said component can be cut away or otherwise removed to provide a range of resistances to the flow of the material when it is ejected from the cartridge.

Preferably wherein said flow restricting component is integral or associable with said nozzle.

Preferably the apparatus as described above further comprising a container for holding a viscous substance said container having a moulded spout without a spout outlet extending from, and with its spout axis within, a male threaded region (i.e. threaded to engage a female threaded complementary nozzle); the moulded spout having a reducing internal periphery (preferably stepped) aligned transversely of the spout axis;

wherein said spout outlet is formed by cutting away or otherwise removing a portion of the spout in a plane perpendicular to the spout axis;

and wherein the size of said spout outlet can be selected according to the diameter of the internal periphery at the location along the spout axis at which the cutting plane is positioned.

Preferably wherein said spout has a stepped external periphery, each step according a predetermined outlet size when cut transversely.

Preferably wherein said apparatus is a combination (whether in assembly or disassembly, or otherwise) of a container having a spout structure and a nozzle attachable to or attached to the container so as to receive the content of the container via the spout when the spout structure has been opened and to allow the liquid to be expressed reliant on pressure applied within the container out of the nozzle's outlet;

wherein one or more discrete opening positions are provided for the spout structure;

and wherein the nozzle has a formed opening and/or has one or more discrete opening positions;

and wherein instructions (or preforming of the spout structure opening) are provided to encourage a flow restriction into the nozzle for the or a particular nozzle opening size.

Preferably wherein said spout structure has a stepped external periphery, each step according a predetermined outlet size when cut transversely.

Preferably wherein the fluid containing cartridge, container or tube comprises a relatively smaller or equal cross-sectional area of infeed for flow of a fluid from a nozzle via an infeed region relative to the cross-sectional area of the outfeed for flow of fluid received from the nozzle via an outfeed region.

The above embodiments and preferred features may be provided in combination with the features described below.

In another aspect of the invention is a cartridge, reservoir or tube as aforesaid or of or for apparatus as aforesaid.

In another aspect of the invention is a nozzle as aforesaid or of or for apparatus as aforesaid.

In another aspect the invention is an apparatus for dispensing viscous fluid, the apparatus being a combination of a cartridge, container or tube containing the fluid and a nozzle attachable to duct to a nozzle outlet fluid to be expressed from the cartridge via an outlet profile when opened, the outlet profile being openable by cutting or the like selectively of the profile to define an opening of increasing area $A_1$, $A_2$ etc;

wherein the nozzle outlet is of area $B_1$ (but optionally can be cut to greater area $B_2$ etc);

and wherein at least $A_1$ is less than or equal to in area than $B_1$.

Preferably $A_2$ is less than or equal to in area than $B_2$ etc.

Preferably said viscous fluid is a sealing, grouting, caulking, levelling, joining agent, an adhesive, and/or another type of viscous liquid, acid, foam, lotion, paste or gel.

Preferably an inner surface (and optionally also an outer surface) of said outlet profile comprises a series of one or two or more concentric cylindrical protrusions.

Preferably an inner surface (and optionally also an outer surface) of said outlet profile comprises a substantially conical or frustoconical surface.

Preferably an inner surface (and optionally also an outer surface) of said outlet profile comprises a stepped or otherwise progressively reducing cross section.

Preferably said opening is formed by cutting away or otherwise removing a portion of the outlet profile.

Preferably said opening is formed by cutting away or otherwise removing a portion of the outlet profile in a plane perpendicular to the longitudinal axis of the outlet profile.

Preferably said opening is substantially circular.

Preferably the size of said opening can be selected by locating the cutting plane at particular positions along the longitudinal axis of the outlet profile.

Preferably there are steps, grooves, notches or other markings or profile features on the outer surface of the outlet profile to:

indicate the various positions at which the cutting plane can be located to achieve the desired opening size; and/or assist in the accurate cutting or removal of material from the outlet profile in a plane located at a particular position.

Preferably said outlet profile is provided by the insertion of a flow restricting component within or proximate to an outlet region of said cartridge, container or tube.

Preferably an inner surface (and optionally also an outer surface) of said flow restricting component comprises a series of one or two or more concentric cylindrical protrusions.

Preferably an inner surface (and optionally also an outer surface) of said flow restricting component comprises a substantially conical or frustoconical surface.

Preferably an inner surface (and optionally also an outer surface) of said flow restricting component comprises a stepped or otherwise progressively reducing cross section.

Preferably said opening is formed by cutting away or otherwise removing a portion of the flow restricting component.

Preferably said opening is formed by cutting away or otherwise removing a portion of the flow restricting component in a plane perpendicular to the longitudinal axis of the restricting component.

Preferably said opening is substantially circular.

Preferably the size of said opening can be selected by locating the cutting plane at particular positions along the longitudinal axis of the flow restricting component.

Preferably there are steps, grooves, notches or other markings or profile features on the outer surface of the flow restricting component to:

indicate the various positions at which the cutting plane can be located to achieve the desired opening size; and/or assist in the accurate cutting or removal of material from the flow restricting component in a plane located at a particular position.

Preferably said flow restricting component is integral to or associable with said nozzle.

Preferably said outlet profile can be adapted by the insertion, within or proximate to said outlet structure, of one of a series of interchangeable flow restricting components, each providing a different sized opening.

Preferably said outlet profile can be adapted, by the insertion of a flow restricting component as previously described or otherwise, to provide an opening having a diameter of any desired size selected from the range of diameters between 1 mm and 10 mm.

In another aspect the invention is a dispensing apparatus (whether in combination, assembly or disassembly) involving a cartridge, container or tube having an outlet region; and an attachable nozzle having an inlet region and an outlet region;

characterised in that or wherein a viscous fluid to be expressed from the cartridge, container or tube into and out of the nozzle is restricted or to be restricted by a smaller or equal sized inlet region into the nozzle from the cartridge, container or tube than the size of the nozzle outlet region.

Preferably said viscous fluid is a sealing, grouting, caulking, levelling, joining agent, an adhesive, and/or another type of viscous liquid, acid, foam, lotion, paste or gel.

Preferably said outlet region of the cartridge container or tube is defined by an outlet profile having an opening.

Preferably said outlet profile is provided by the insertion of a flow restricting component within or proximate to an outlet region of said cartridge, container or tube.

Preferably an inner surface (and optionally also an outer surface) of said outlet profile comprises a series of one or two or more concentric cylindrical protrusions.

Preferably an inner surface (and optionally also an outer surface) of said outlet profile comprises a substantially conical or frustoconical surface.

Preferably an inner surface (and optionally also an outer surface) of said outlet profile comprises a stepped or otherwise progressively reducing cross section.

Preferably said opening is formed by cutting away or otherwise removing a portion of the outlet profile.

Preferably said opening is formed by cutting away or otherwise removing a portion of the outlet profile in a plane perpendicular to the longitudinal axis of the outlet profile.

Preferably said opening is substantially circular.

Preferably the size of said opening can be selected by locating the cutting plane at particular positions along the longitudinal axis of the outlet profile.

Preferably there are steps, grooves, notches or other markings or profile features on the outer surface of the outlet profile to:

indicate the various positions at which the cutting plane can be located to achieve the desired opening size; and/or assist in the accurate cutting or removal of material from the outlet profile in a plane located at a particular position.

Preferably said outlet profile can be provided by the insertion, within or proximate to the outlet region of said cartridge, container or tube, of one of a series of interchangeable flow restricting components, each providing a different sized opening.

Preferably said outlet profile can, by the insertion of a flow restricting component as previously described or otherwise, provide an opening having a diameter of any desired size selected from the range of diameters between 1 mm and 10 mm.

In another aspect the invention is a method of enhancing the control of a viscous fluid dispensing as a bead on a surface which involves ensuring a smaller or equal cross sectional area of infeed flow from a fluid containing cartridge, container or tube into a nozzle via an infeed region than the cross sectional area of the outfeed flow of received fluid from the nozzle via an outfeed region.

Preferably said viscous fluid is a sealing, grouting, caulking, levelling, joining agent, an adhesive, and/or another type of viscous liquid, acid, foam, lotion, paste or gel.

Preferably said infeed region of the nozzle is defined by and complementary to an outlet profile having an opening; said outlet profile being integral to or associated with said cartridge, container or tube.

Preferably said outlet profile is provided by the insertion of a flow restricting component within or proximate to an outlet region of said cartridge, container or tube.

Preferably an inner surface (and optionally also an outer surface) of said outlet profile comprises a series of one or two or more concentric cylindrical protrusions.

Preferably an inner surface (and optionally also an outer surface) of said outlet profile comprises a substantially conical or frustoconical surface.

Preferably an inner surface (and optionally also an outer surface) of said outlet profile comprises a stepped or otherwise progressively reducing cross section.

Preferably said opening is formed by cutting away or otherwise removing a portion of the outlet profile.

Preferably said opening is formed by cutting away or otherwise removing a portion of the outlet profile in a plane perpendicular to the longitudinal axis of the outlet profile.

Preferably said opening is substantially circular.

Preferably the size of said opening can be selected by locating the cutting plane at particular positions along the longitudinal axis of the outlet profile.

Preferably there are steps, grooves, notches or other markings or profile features on the outer surface of the outlet profile to:

indicate the various positions at which the cutting plane can be located to achieve the desired opening size; and/or assist in the accurate cutting or removal of material from the outlet profile in a plane located at a particular position.

Preferably said outlet profile can be provided by the insertion, within or proximate to the outlet region of said cartridge, container or tube, of one of a series of interchangeable flow restricting components, each providing a different sized opening.

Preferably said outlet profile can, by the insertion of a flow restricting component as previously described or otherwise, provide an opening having a diameter of any desired size selected from the range of diameters between 1 mm and 10 mm.

In yet another aspect the invention is a flow restricting component for use in conjunction with a cartridge, reservoir or tube containing viscous contents, said cartridge, reservoir or tube having an outlet region and a mechanism by which its contents can be expressed or ejected through the outlet region under the application of external pressure;

wherein said flow restricting component is adapted to fit over or inside of said outlet region;

and wherein said flow restricting component provides one or more openings through which the contents can subsequently flow.

Preferably portions of said component can be cut away or otherwise removed to provide a range of resistances to the flow of the material when it is ejected from the cartridge.

Preferably an inner surface (and optionally also an outer surface) of said flow restricting component comprises a series of one or two or more concentric cylindrical protrusions.

Preferably an inner surface (and optionally also an outer surface) of said flow restricting component comprises a substantially conical or frustoconical surface.

Preferably an inner surface (and optionally also an outer surface) of said flow restricting component comprises a stepped or otherwise progressively reducing cross section.

Preferably said outlet aperture is formed by cutting away or otherwise removing a portion of the flow restricting component.

Preferably said outlet aperture is formed by cutting away or otherwise removing a portion of the flow restricting component in a plane perpendicular to the longitudinal axis of the restricting component.

Preferably said outlet aperture is substantially circular.

Preferably the size of said outlet aperture can be selected by locating the cutting plane at particular positions along the longitudinal axis of the flow restricting component.

Preferably there are steps, grooves, notches or other markings or profile features on the outer surface of the flow restricting component to:

indicate the various positions at which the cutting plane can be located to achieve the desired outlet aperture size; and/or assist in the accurate cutting or removal of material from the flow restricting component in a plane located at a particular position.

In another aspect the invention is a container for holding a viscous substance said container having a moulded spout without a spout outlet extending from, and with its spout axis within, a male threaded region (i.e. threaded to engage a female threaded complementary nozzle); the moulded spout having a reducing internal periphery (preferably stepped) aligned transversely of the spout axis;

wherein said spout outlet is formed by cutting away or otherwise removing a portion of the spout in a plane perpendicular to the spout axis;

and wherein the size of said spout outlet can be selected according to the diameter of the internal periphery at the location along the spout axis at which the cutting plane is positioned.

Preferably said spout has a stepped external periphery, each step according a predetermined outlet size when cut transversely.

Preferably an inner surface (and optionally also an outer surface) of said spout comprises a series of one or two or more concentric cylindrical protrusions.

Preferably an inner surface (and optionally also an outer surface) of said spout comprises a substantially conical or frustoconical surface.

Preferably there are steps, grooves, notches or other markings or profile features on the outer surface of the spout to:

indicate the various positions at which the cutting plane can be located to achieve the desired outlet size; and/or assist in the accurate cutting or removal of material from the spout in a plane located at a particular position.

In yet another aspect the invention is the combination (whether in assembly or disassembly, or otherwise) of a container having a spout structure and a nozzle attachable to or attached to the container so as to receive the content of the container via the spout when the spout structure has been opened and to allow the liquid to be expressed reliant on pressure applied within the container out of the nozzle's outlet;

wherein one or more discrete opening positions are provided for the spout structure;

and wherein the nozzle has a formed opening and/or has one or more discrete opening positions;

and wherein instructions (or preforming of the spout structure opening) are provided to encourage a flow restriction into the nozzle for the or a particular nozzle opening size.

Preferably said spout structure has a stepped external periphery, each step according a predetermined outlet size when cut transversely.

Preferably an inner surface (and optionally also an outer surface) of said spout structure comprises a series of one or two or more concentric cylindrical protrusions.

Preferably an inner surface (and optionally also an outer surface) of said spout structure comprises a substantially conical or frustoconical surface.

Preferably there are steps, grooves, notches or other markings or profile features on the outer surface of the spout structure to:

indicate the various positions at which the cutting plane can be located to achieve the desired opening size; and/or assist in the accurate cutting or removal of material from the spout in a plane located at a particular position.

It will be appreciated the various embodiments and preferred features as described above can be provided in combination with each other. Such combinations being contemplated as part of this invention.

As used herein the term "and/or" means "and" or "or", or both.

As used herein the term "(s)" following a noun includes, as might be appropriate, the singular or plural forms of that noun.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

A preferred form of the present invention will now be described with reference to the accompanying drawings in which.

DETAILED DESCRIPTION OF PREFERRED EMBODIMENTS

The present invention is a component or an assembly of components which can be used in conjunction with a cartridge, container or tube 1 containing a viscous material, wherein the cartridge, container or tube 1 allows for the material to be expressed under the application of external pressure, either by a ram or trigger mechanism (for example as seen on a silicone cartridge) 13 or by some other direct or indirect transmission of force (for example a squeezable bottle or tube). The application of pressure may be continuous or semi-continuous, but in some instances could be cyclical or non-continuous.

Figure 1:
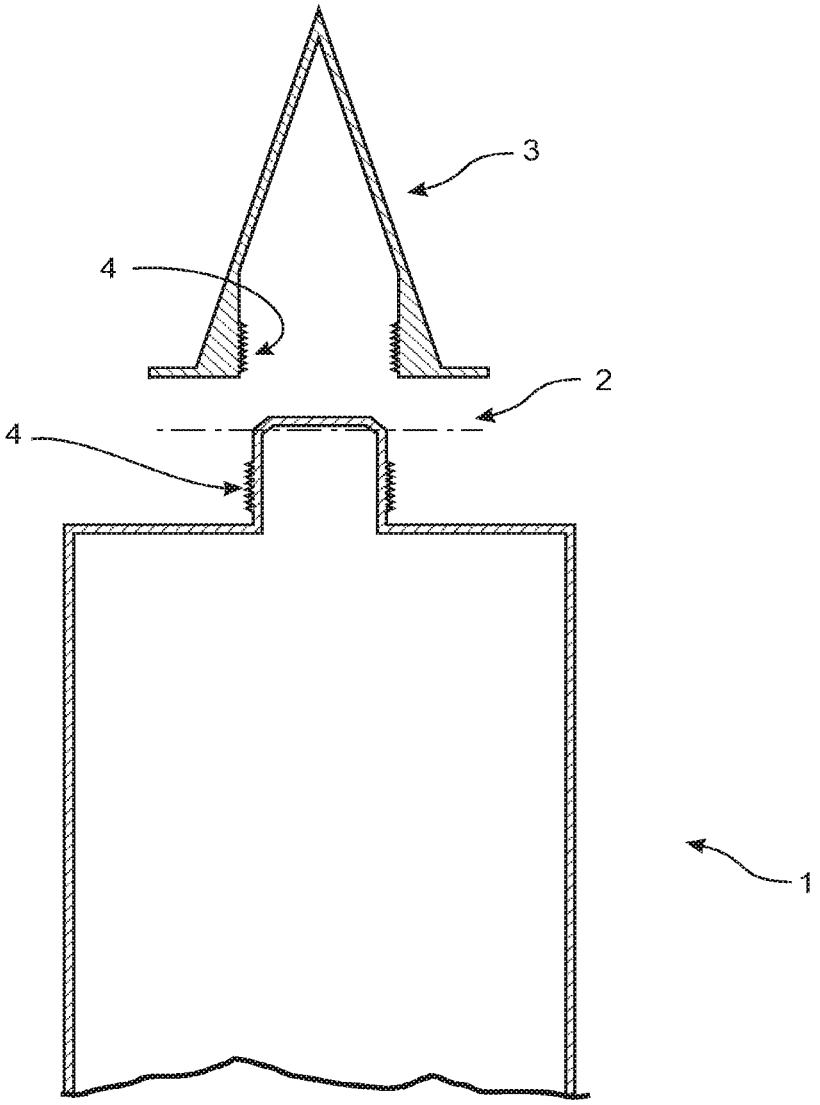
FIG. 1 shows a cross sectional view of the top of a cartridge and a nozzle to be assembled by a threaded connection.

Generally such cartridges, containers and tubes are supplied in a sealed state (as shown in FIG. 1) to prevent air from reaching their contents. The opening through which the material is to be expressed will be created immediately prior to use with the aid of a readily available implement such as a knife, hacksaw or drill, for example by cutting along line 2. Alternatively there may be a lid or cap which can be removed to create the opening. For example, there may also be a frangible or rupturable film or membrane removable by a user or removable on application of the external pressure, such that an outlet aperture of a pre-determined size is provided.

It is envisaged that a separate nozzle piece 3, able to be attached to the outlet region by a threaded connection 4 (as shown in FIG. 1) or other type of connection, will be provided along with the cartridge 1 to aid in the application of the viscous material. In yet other embodiments, such a nozzle piece 3 may be an integral part of a cartridge, reservoir or tube 1.

Some examples of some of the types of viscous material toward which the invention is directed are silicone, epoxy, polyurethane and other viscous adhesive, caulking, sealing, grouting, levelling or joining agents, liquids, acids, foams, lotions, gels and pastes. These agents are widely available in the types of cartridges, containers and tubes described above.

Figure 2:
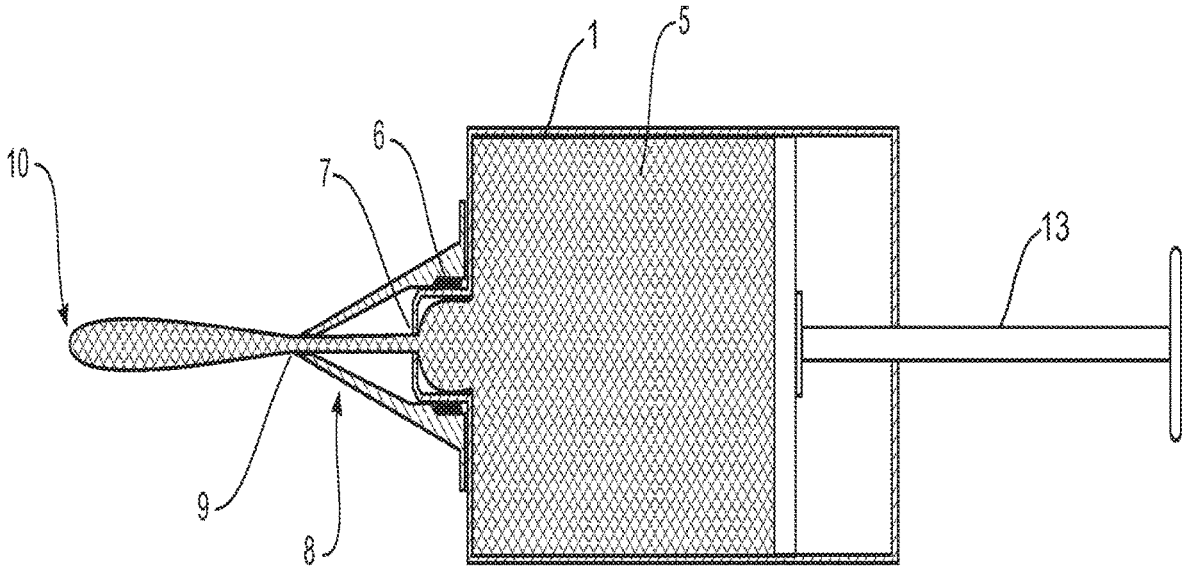
FIG. 2 shows a cross sectional view of a cartridge having a flow restricting orifice according to the present invention, said cartridge having a nozzle attachment and being filled with a viscous material to be expressed from the cartridge under the application of external pressure.

The main features of a preferred embodiment of the present invention are as shown in FIG. 2. The viscous material 5 will be ejected from the cartridge 1 through outlet region 6, and will then encounter a flow restricting orifice 7 before flowing through into a conical nozzle region 8. The material will then be ejected through the nozzle outlet 9 and form a bead 10 under a continuous or substantially continuous pressure.

The cross sectional area of the nozzle outlet 9 should be the same size as, or larger than that of the flow restricting orifice 7. Preferably both the nozzle outlet 9 and the restricting orifice 7 are circular in shape, however this need not be the case.

Because the flow of the material is restricted before it gets to the nozzle region 8, it is easier to control the formation of the bead 10 at the nozzle outlet 9. For a given linear speed of movement of the nozzle relative to the application surface, the bead 10 which comes out of the nozzle outlet 9 will be thinner and more even than if no flow restrictor had been used. This results in less wastage of the viscous material 5, better application control and, where applicable, more even drying and/or bonding of the viscous material. The bead will be continuous along the length of the join or surface rather than being intermittent in parts.

The thin, continuous bead is particularly advantageous in adhesive dispensing applications where a pressure sensitive adhesive is being used. The consistency of the bead ensures an even bond pressure and allows the mating surfaces to be evenly wet out for sufficient bonding in all regions of the bead.

Another advantage to the restrictor is that there is less pressure inside the nozzle at the outlet 9. The material will not continue leaking from the outlet 9 after the user has stopped actively applying pressure to the cartridge 1 due to pressure build up in the nozzle.

Beads of silicone, all applied at approximately the same linear speed of movement of the nozzle relative to the application surface, but using different sized nozzle and restrictor combinations are shown in FIGS. 3 and 4.

Figure 3A:
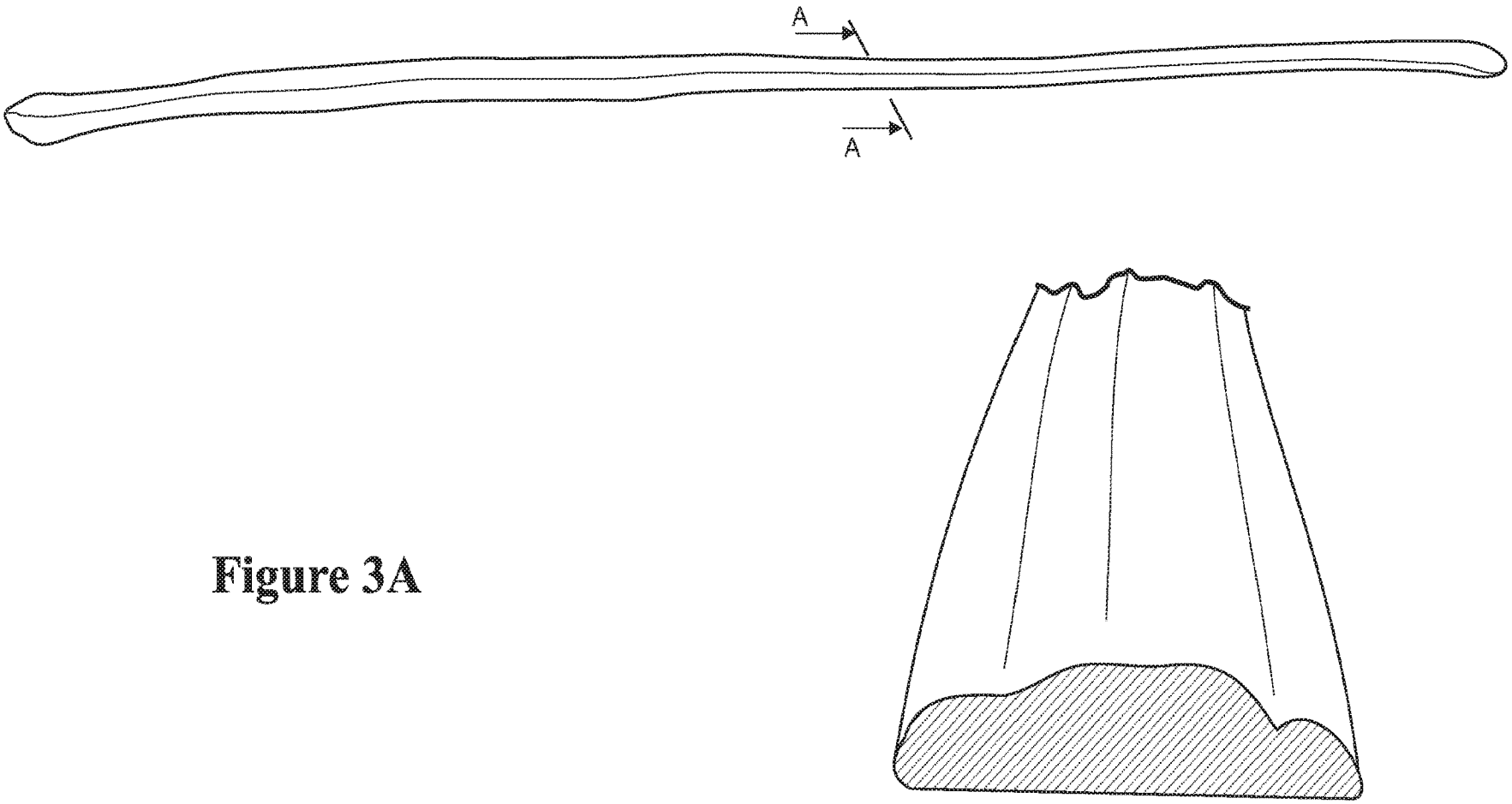
FIGS. 3A, 3B and 3C show beads of sealing material having been applied from a cartridge through a nozzle having a 7.5 mm diameter outlet and at the same linear speed of movement of the nozzle relative to the application surface, but each having passed through a different sized restrictor orifice prior to the outlet, each of which additionally illustrate a cross-sectional view as A-A, B-B, or C-C.
Figure 3B:
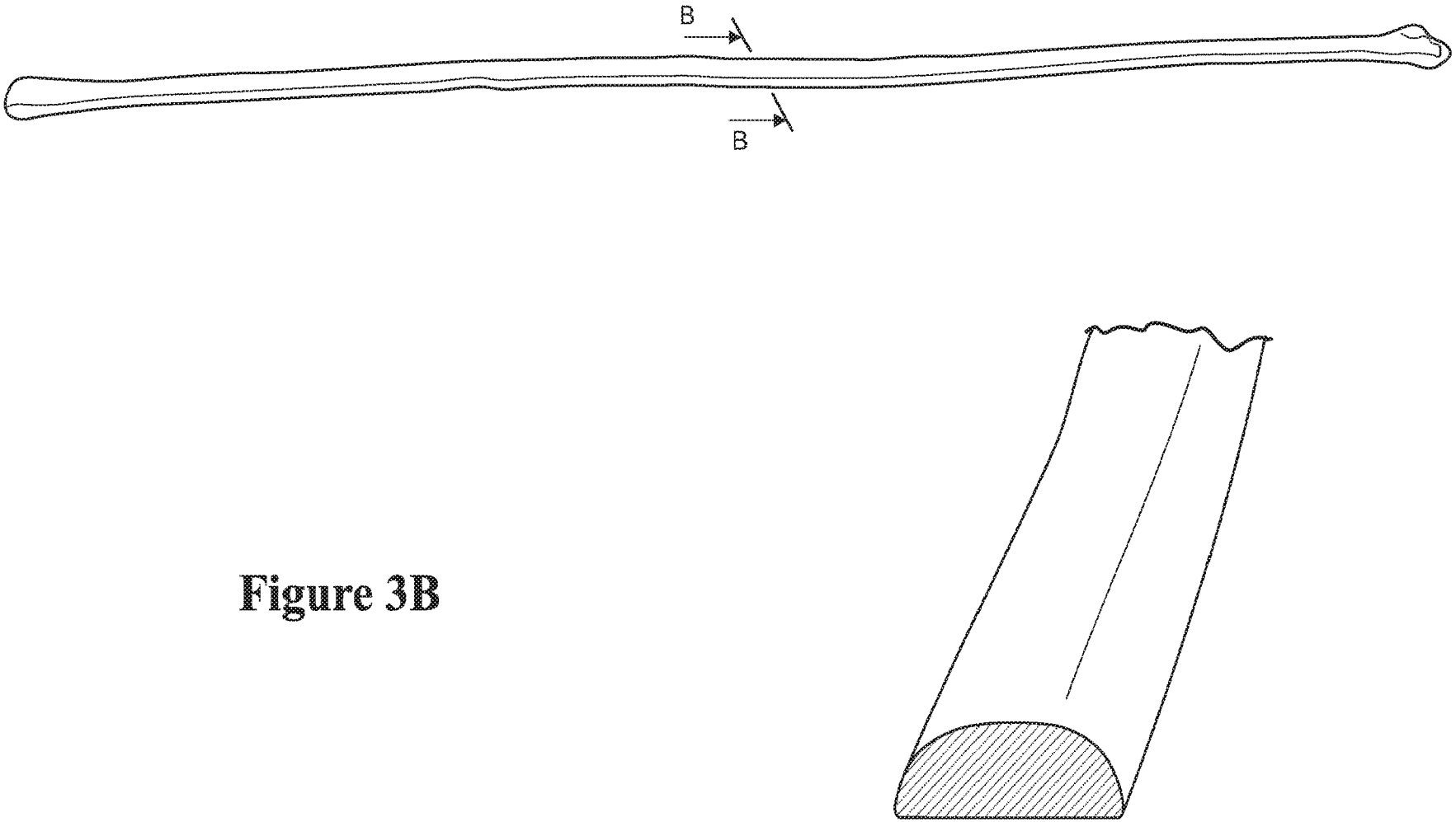
Figure 3C:
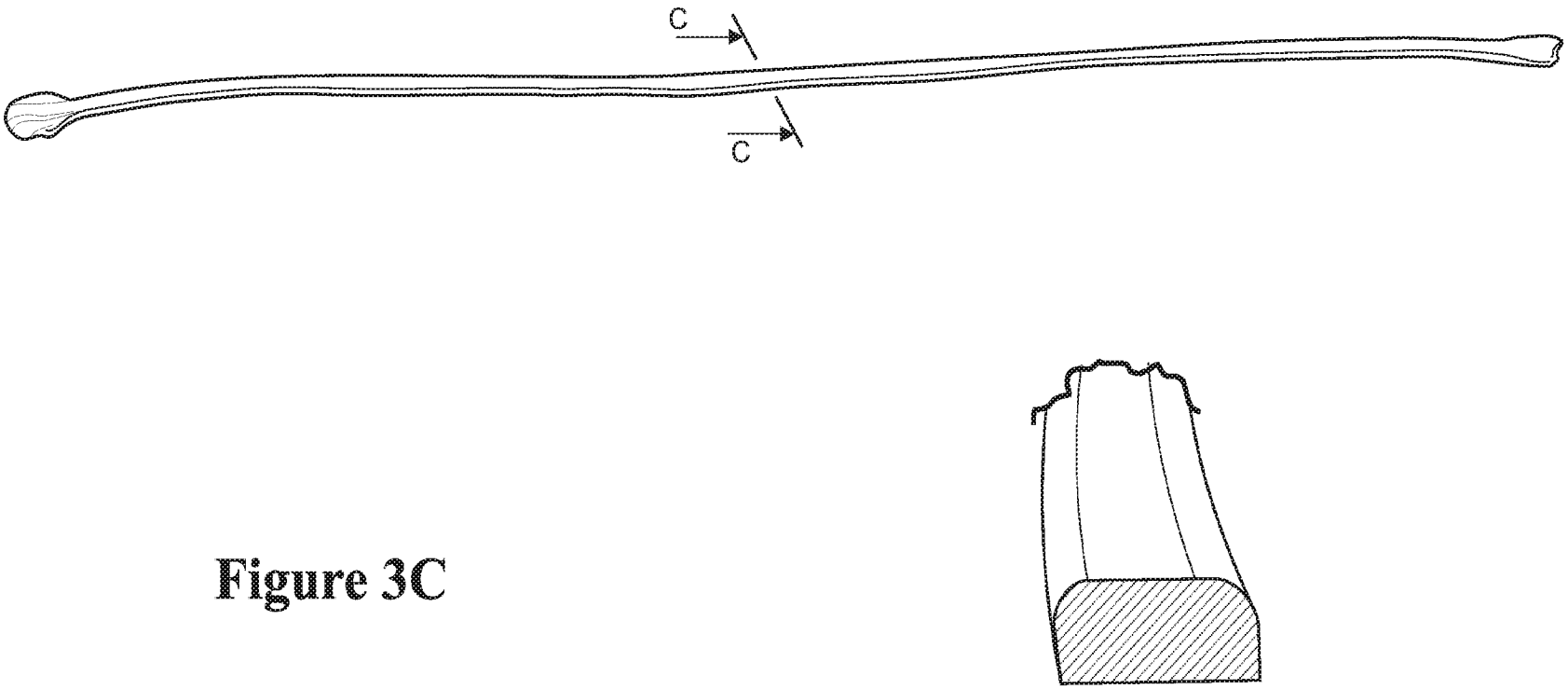

FIG. 3A shows a strip of sealing agent which has been applied through a nozzle opening 9 of 7.5 mm in diameter from a cartridge having an 8 mm diameter outlet region 6 and no restrictor. An illustrative cross section is also shown. FIG. 3B shows a strip applied through the same sized nozzle outlet 9, but wherein a 5 mm restrictor orifice 7 has been placed at the outlet region 6. An illustrative cross section is also shown. It can be seen that a thinner, smoother and more uniform bead 10 has been achieved with the use of the restrictor. Similarly, use of a 2.5 mm diameter restrictor orifice 7 gives an even thinner and more easily controllable bead 10 as shown in FIG. 3C (illustrative cross section also shown).

Figure 4A:
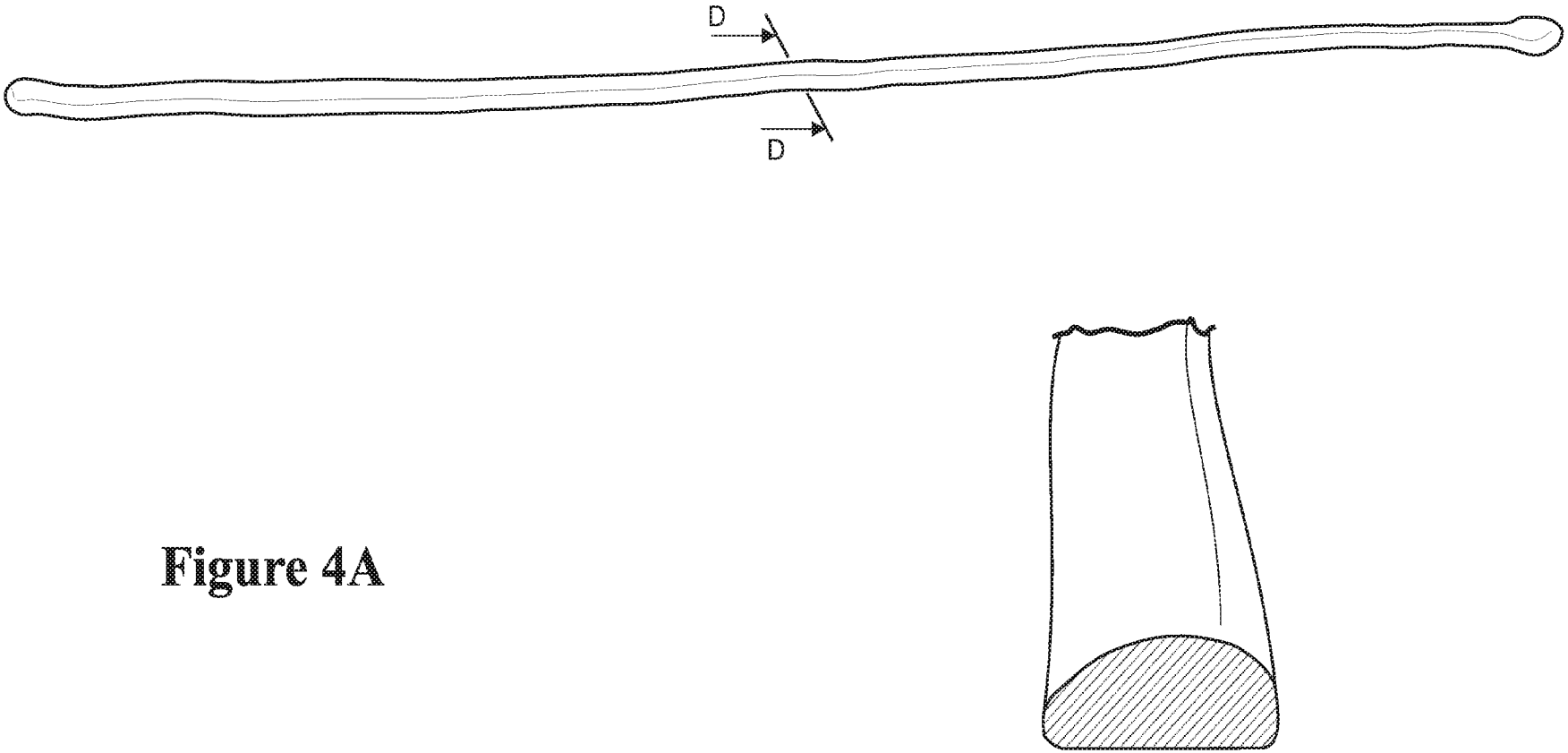
FIGS. 4A and 4B show beads of sealing material having been applied from a cartridge through a nozzle having a 5 mm diameter outlet and at the same linear speed of movement of the nozzle relative to the application surface, but each having passed through a different sized restrictor orifice prior to the outlet, each of which additionally illustrate a cross-sectional view as D-D or E-E.
Figure 4B:
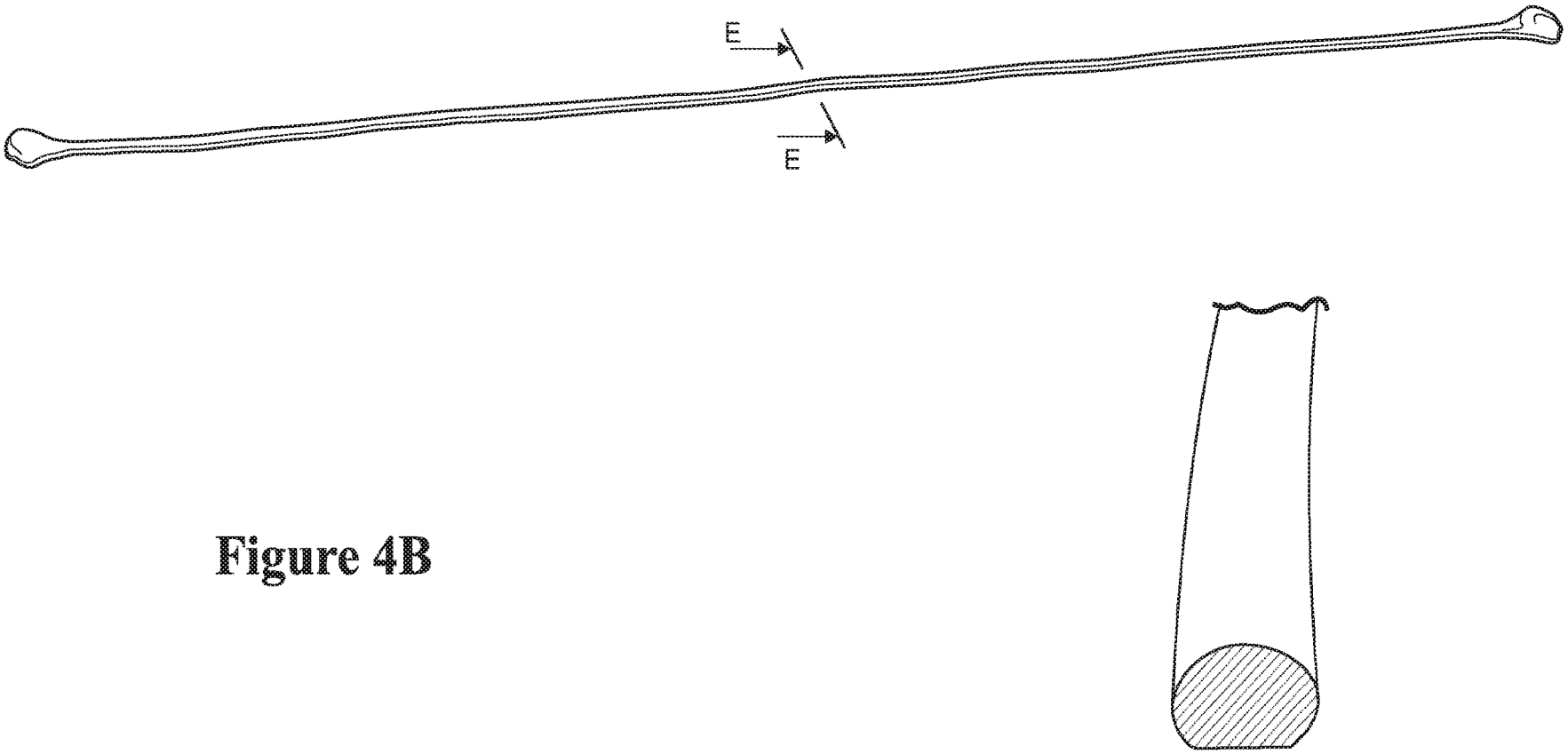

A similar difference can be seen when comparing FIG. 4A, which shows a bead 10 applied through a 5 mm diameter nozzle outlet 9 in the absence of a restrictor and FIG. 4B which shows a bead 10 applied through the same outlet 9 with a 2.5 mm diameter restrictor orifice 7. Illustrative cross sections are also shown alongside the respective beads. In some cases the restrictor orifice 7 and the nozzle outlet 9 may have the same diameter, but there will still be some utility in this arrangement because the restrictor will reduce the pressure behind the nozzle outlet 9 so that the flow is easier to control.

Figure 5:
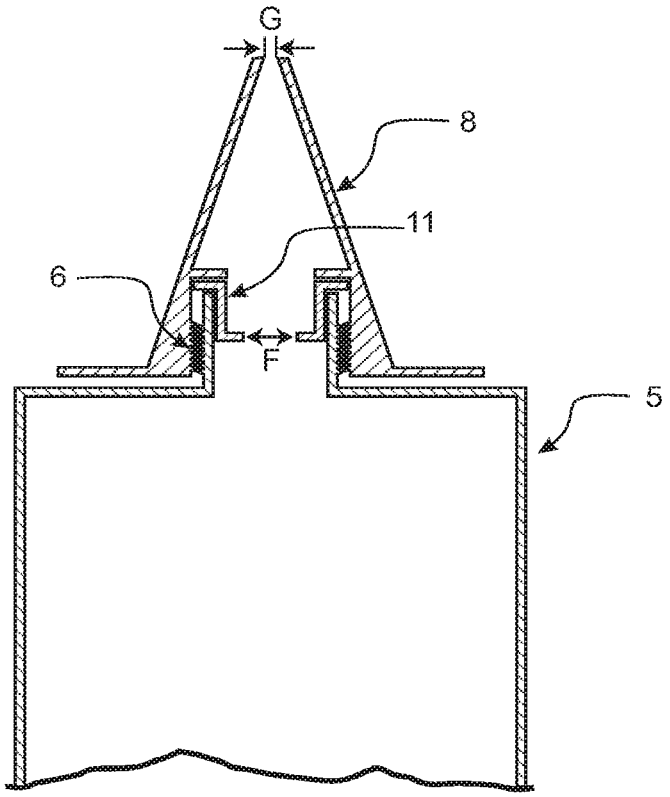
FIG. 5 shows a flow restricting assembly of the present invention having a separate and possibly removable or interchangeable insert to provide a flow restricting orifice.
Figure 6:
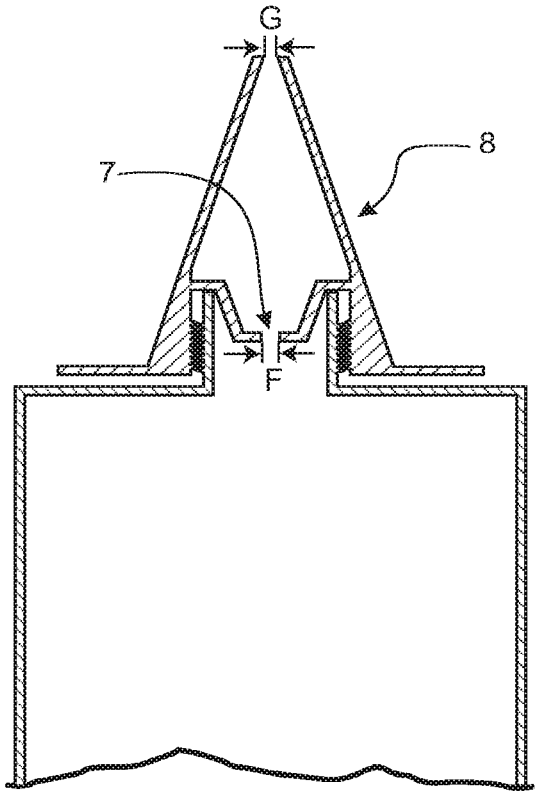
FIG. 6 shows another embodiment of the flow restricting assembly wherein the orifice is integral to the nozzle component.
Figure 10:
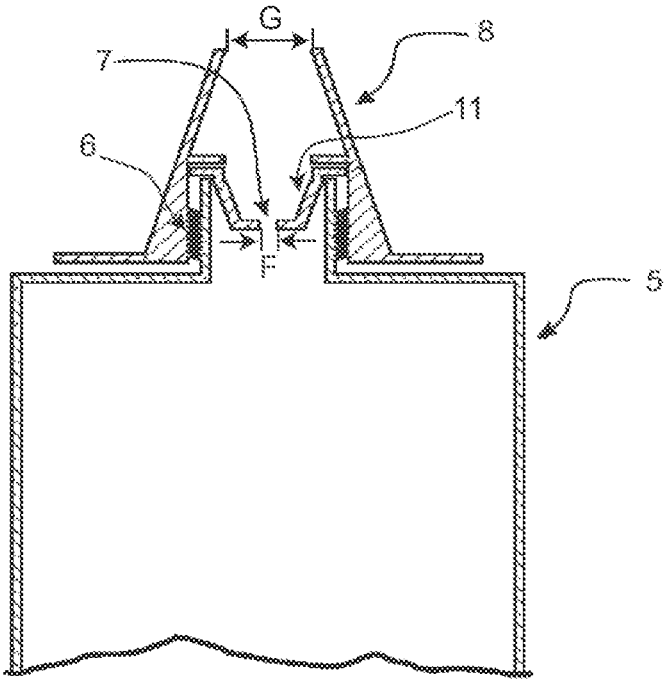
FIG. 10 shows another embodiment of the flow restricting assembly having a separate and possibly removable or interchangeable insert to provide a flow restricting orifice.
Figure 11:
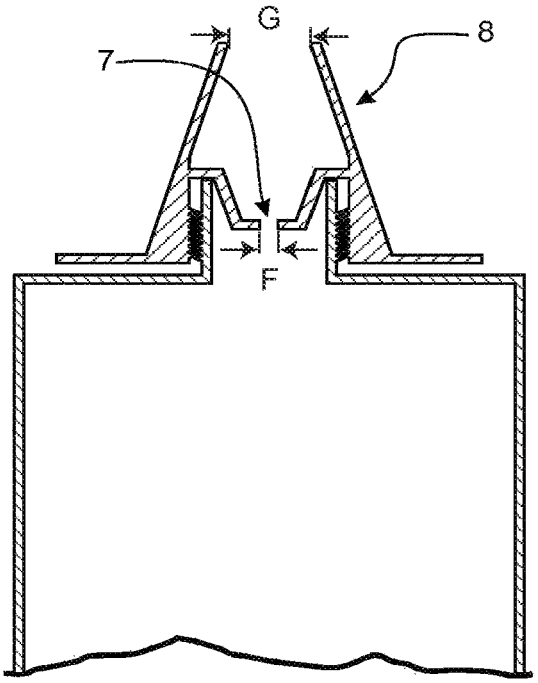
FIG. 11 shows yet another embodiment of the flow restricting assembly wherein the orifice is integral to the nozzle component.

The flow restricting orifice 7 may be integral to the shape of the outlet region 6 of the cartridge 1, or may be provided by way of a separate insert 11 which is fitted between the conical nozzle 8 and the outlet region 6 of the cartridge 1. An example of how this might be assembled is shown in FIG. 5. In the embodiment shown is FIG. 5, the cross-section area F of the flow restricting orifice 7 is greater than the cross-sectional area G of the conical nozzle component 8. Another example of how this might be assembled is shown in FIG. 6. Alternatively, the restrictor orifice 7 could be integral to the conical nozzle component 8, as shown in FIG. 6. In further embodiments the restrictor component may be associated with the nozzle in such a way as to be removable or interchangeable. One or more such flow restricting components (e.g. a nozzle) may be provided to together provide for an outlet or aperture of a pre-determined cross-sectional area, such that the outlet through which a fluid is expressed into a nozzle is of equal or lesser size than the size of the outlet from the nozzle from which the fluid is expressed. Other examples of how this might be assembled are shown in FIG. 10 and FIG. 11. In the embodiments shown in FIG. 10 and FIG. 11, the cross-sectional area F of the flow restricting orifice 7 is less than the cross-sectional area G of the conical nozzle component 8.

The size of the nozzle outlet 9 can be varied by cutting the conical nozzle 8 at different distances from its apex in order to achieve the desired bead size.

The size of the bead 10 required, and in particular its cross sectional width, will depend upon the application. For example, plumbing applications may call for a thicker bead than grouting or tiling applications. For this reason the nozzle 8 may be supplied with a reasonably narrow aperture at its apex (or no aperture), so that the user can cut the nozzle outlet 9 to size as needed. The present invention envisages that the size of the restrictor orifice 7 be similarly adjustable by way of cutting or snapping off portions of the outlet region 6 in order to achieve a restrictor of dimensions which are appropriate and/or optimal given the chosen size of the nozzle outlet 9.

Figure 7:
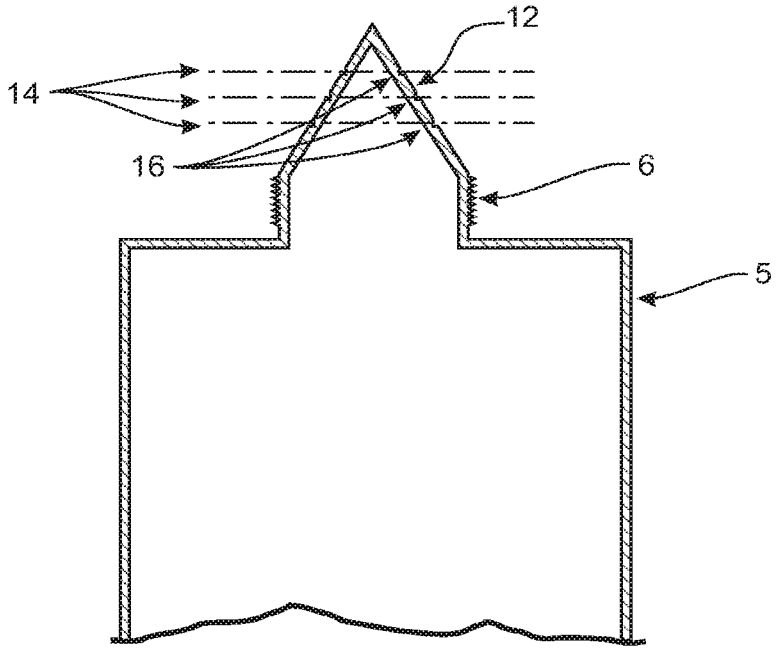
FIG. 7 shows a cartridge having a conical surface about the top of the outlet region which can be cut to provide a range of different restrictor orifice sizes.

The first way in which such an adjustable restrictor orifice 7 can be provided is, as shown in FIG. 7, to add (integrally or as a separate component) a conical or substantially conical surface 12 to a cylindrically protruding outlet region 6 of the cartridge 1. This surface 12 can then be cut at varying distances from the apex to give the desired orifice diameter. There may be markings 14 or other indicators to assist in locating the cut.

Figure 8:
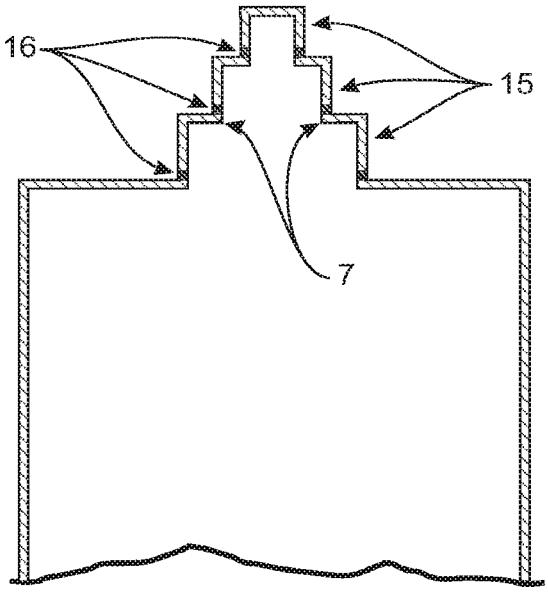
FIG. 8 shows a cartridge having a series of stepped protrusions about the top of the outlet region which can be accurately cut to provide a range of different restrictor orifice sizes.

In another embodiment the cartridge 1 is provided with a series of concentric cylindrical protrusions 15 as shown in FIG. 8. These protrusions 15 can be cut off or otherwise removed according to the size of the orifice 7 required. Again, notches 16 or other profile features may assist in locating the cut.

Figure 9:
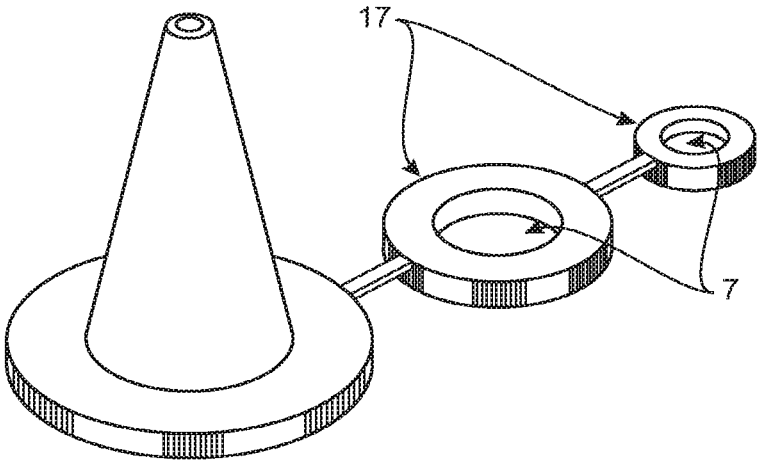
FIG. 9 shows a nozzle component having a series of snap off restrictor inserts to be used as part of an assembly of the current invention.

A further alternative, shown in FIG. 9, is to provide, perhaps moulded as part of the conical nozzle, or perhaps as a separate component, a series of snap off inserts 17 each having a different sized orifice 7. The inserts can be used, interchanged, disposed of and replaced as necessary.

For typical sealing and adhesive cartridges it is convenient to provide restrictors which can provide 2.5 mm, 5 mm and 7.5 mm or 8 mm restrictor orifice sizes. For other cartridges, containers and tubes the size range and increments will vary depending on the application.

The foregoing description of the invention includes preferred forms thereof. Modifications may be made thereto without departing from the scope of the invention.

The invention claimed is:

1. An apparatus for dispensing a viscous fluid, said apparatus comprising:

a cartridge configured to be received in a dispensing mechanism, said cartridge containing the viscous fluid and comprising an outlet structure through which said viscous fluid can be expressed under application of an external pressure from said dispensing mechanism;

a nozzle engageable with the outlet structure of said cartridge;

wherein the openable or opened outlet structure is adapted to provide on opening an outlet aperture having a size of area A;

and wherein the nozzle has or is adapted to be cut to provide a nozzle outlet of area B, area B being greater than or equal to area A;

wherein there are steps, grooves, notches or other markings or profile features on an outer surface of the outlet structure to:

indicate the various positions at which the cutting plane can be located to achieve the desired outlet aperture size; and/or assist in the accurate cutting or removal of material from the outlet structure in a plane located at a particular position;

wherein the nozzle converges towards the nozzle outlet;

wherein the nozzle is conical and has a smallest diameter at the nozzle outlet; and wherein at least one of an inner surface or the outer surface of said outlet structure comprises a series of one or two or more concentric cylindrical protrusions.

2. The apparatus as claimed in claim 1, wherein said viscous fluid is one or more of: a sealing, grouting, caulking, levelling, joining agent, an adhesive, and/or another type of viscous liquid, acid, foam, lotion, paste or gel.

3. The apparatus as claimed in claim 1, wherein at least one of an inner surface or the outer surface of said outlet structure comprises a stepped or otherwise progressively reducing cross section.

4. The apparatus as claimed in claim 1, wherein said outlet aperture is formed by cutting away or otherwise removing a portion of the outlet structure.

5. The apparatus as claimed in claim 1, wherein said outlet aperture is formed by cutting away or otherwise removing a portion of the outlet structure in a plane at least substantially perpendicular to the longitudinal axis of the outlet structure.

6. The apparatus as claimed in claim 1, wherein said outlet aperture is substantially circular.

7. The apparatus as claimed in claim 1, wherein a size of said outlet aperture can be selected by locating the cutting plane at particular positions along the longitudinal axis of the outlet structure.

8. An apparatus for dispensing a viscous fluid, said apparatus comprising:

a cartridge configured to be received in a dispensing mechanism, said cartridge containing the viscous fluid and comprising an outlet structure through which said viscous fluid can be expressed under application of an external pressure from said dispensing mechanism;

a nozzle engageable with the outlet structure of said cartridge, wherein the outlet structure includes a flow restricting component with an outlet aperture having a size of area A;

wherein the nozzle has or is adapted to be cut to provide a nozzle outlet of area B, area B being greater than or equal to area A; and wherein there are steps, grooves, notches or other markings or profile features on an outer surface of the flow restricting component to:

indicate the various positions at which the cutting plane can be located to achieve the desired outlet aperture size; and/or assist in the accurate cutting or removal of material from the flow restricting component in a plane located at a particular position; and wherein at least one of an inner surface or the outer surface of said flow restricting component comprises a series of one or two or more concentric cylindrical protrusions.

9. The apparatus as claimed in claim 8, wherein at least one of an inner surface or the outer surface of said flow restricting component comprises a stepped or otherwise progressively reducing cross section.

10. The apparatus as claimed in claim 8, wherein said outlet aperture is formed by cutting away or otherwise removing a portion of the flow restricting component.

11. The apparatus as claimed in claim 8, wherein said outlet aperture is formed by cutting away or otherwise removing a portion of the flow restricting component in a plane perpendicular to the longitudinal axis of the restricting component.

12. The apparatus as claimed in claim 8, wherein said outlet aperture is substantially circular.

13. The apparatus as claimed in claim 8, wherein the size of said outlet aperture can be selected by locating the cutting plane at particular positions along the longitudinal axis of the flow restricting component.

14. The apparatus as claimed in claim 8, wherein said flow restricting component is associable with said nozzle.

15. The apparatus as claimed in claim 8, wherein said nozzle converges toward an end.

* * * * *